US011311089B2

(12) United States Patent
Morszeck

(10) Patent No.: US 11,311,089 B2
(45) Date of Patent: Apr. 26, 2022

(54) ITEM OF LUGGAGE

(71) Applicant: RIMOWA GmbH, Cologne (DE)

(72) Inventor: Dieter Morszeck, Cologne (DE)

(73) Assignee: RIMOW A GmbH, Cologne (DE)

( * ) Notice: Subject to any disclaimer, the term of this patent is extended or adjusted under 35 U.S.C. 154(b) by 560 days.

(21) Appl. No.: 16/062,273

(22) PCT Filed: Dec. 21, 2016

(86) PCT No.: PCT/EP2016/082265
§ 371 (c)(1),
(2) Date: Jun. 14, 2018

(87) PCT Pub. No.: WO2017/109010
PCT Pub. Date: Jun. 29, 2017

(65) Prior Publication Data

US 2018/0360181 A1 Dec. 20, 2018

(30) Foreign Application Priority Data

Dec. 23, 2015 (EP) ..... 15202408

(51) Int. Cl.
*A45C 13/06* (2006.01)
*A45C 5/03* (2006.01)
(Continued)

(52) U.S. Cl.
CPC ..... *A45C 13/06* (2013.01); *A45C 5/03* (2013.01); *A45C 13/04* (2013.01); *A45C 13/36* (2013.01)

(58) Field of Classification Search
CPC ..... A45C 13/06; A45C 5/03; A45C 13/04; A45C 13/36
See application file for complete search history.

(56) References Cited

U.S. PATENT DOCUMENTS 1,596,561 A * 8/1926 Tueckmantel ..... A45C 13/04 190/121
1,930,935 A * 10/1933 Hiering ..... A45C 13/06 150/123

(Continued)

FOREIGN PATENT DOCUMENTS

CH 615328 A5 1/1980
DE 2015530 A1 12/1970

OTHER PUBLICATIONS

Office Action dated Jun. 4, 2019, in corresponding Chinese Application No. 201680075834.6 including partial machine-generated English language translation; 4 pages.

(Continued)

*Primary Examiner* — Tri M Mai
(74) *Attorney, Agent, or Firm* — Maier & Maier, PLLC

(57) ABSTRACT

An item of luggage including a body of the item of luggage with at least one first and one second portion of the item of luggage. The first and the second portion of the item of luggage are adapted to be pivoted relative to each other such that the body of the item of luggage can be opened or closed, at least one handle which is connected to the second portion of the item of luggage, at least one first and one second frame element, the first frame element is arranged at an edge of the first portion of the item of luggage and the second frame element is arranged at an edge of the second portion of the item of luggage, and at least the first frame element comprises a first recess.

12 Claims, 3 Drawing Sheets

(51) Int. Cl.
*A45C 13/04* (2006.01)
*A45C 13/36* (2006.01)

(56) References Cited

U.S. PATENT DOCUMENTS

| | | | | | |
|---|---|---|---|---|---|
| 2,707,505 | A * | 5/1955 | Klehr | A45C 3/02 | 190/121 |
| 2,717,093 | A * | 9/1955 | Mautner | B65D 9/32 | 217/56 |
| 2,737,219 | A * | 3/1956 | Lifton | A45C 3/02 | 190/115 |
| 2,950,793 | A | 8/1960 | Axtell | | |
| 3,405,788 | A * | 10/1968 | Mckim | A45C 5/02 | 190/121 |
| 3,497,041 | A * | 2/1970 | Samhammer | A45C 5/03 | 190/18 R |
| 4,363,226 | A * | 12/1982 | Remington | E05B 37/02 | 292/28 |
| 4,366,685 | A * | 1/1983 | Remington | E05B 37/02 | 70/312 |
| 2008/0230157 | A1* | 9/2008 | Whiting | A45C 13/02 | 150/104 |

OTHER PUBLICATIONS

International Search Report dated Apr. 4, 2017 of corresponding International Application No. PCT/EP2016/082265; 5 pgs.

* cited by examiner

ITEM OF LUGGAGE

FIELD

The invention relates to an item of luggage as well as a method for locking the item of luggage.

BACKGROUND

Items of luggage, in particular suitcases, are known which comprise a body of the item of luggage having at least one first and one second portion of the item of luggage, wherein the first and the second portion of the item of luggage are adapted to be pivoted relative to each other such that the body of the item of luggage can be opened or closed. Further, at least one handle is frequently provided which is connected to the second portion of the item of luggage. Frequently a first and a second frame element are provided, wherein the first frame element is arranged at an edge of the first portion of the item of luggage and the second frame element is arranged at an edge of the second portion of the item of luggage, wherein at least the first frame element comprises a first recess. The first and the second frame element engage with each other in the closed state and are contiguous with each other in the closed state.

In the conventional items of luggage, a problem frequently arises that in particular when the item of luggage is loaded and lifted, a gap occurs between the first and the second portion of the item of luggage.

SUMMARY

It is therefore an object of the present invention to provide an item of luggage and a method with the aid of which a gap is prevented from occurring between the first and the second portion of the item of luggage when the item of luggage is lifted in its closed and loaded state.

According to the invention, advantageously at least one hook element is arranged at the second portion of the item of luggage, said hook element extending over the first frame element in the closed state of the item of luggage and engaging with the recess in a state in which the item of luggage is loaded and lifted by the handle, wherein the hook element does not engage with the recess in a state in which the item of luggage is not lifted.

The present invention offers the advantage that the hook element engages with the first recess of the first frame element when the loaded and closed body of the item of luggage is lifted. Thus no gap can occur between the first and the second portion of the item of luggage. Further, the present invention offers the advantage that in the non-lifted state and/or in the non-loaded state the body of the item of luggage can be easily opened since the hook element does not engage with the first recess.

The hook element may be connected, in particular screwed and/or glued, to the second frame element.

The hook element may further be connected to the handle. In particular, the hook element may be screwed to the handle.

The first and the second frame element may be contiguous with each other in the closed state of the body of the item of luggage and at least partially engage with each other.

In the closed state of the body of the item of luggage a sealing element may be arranged between the first and the second frame element.

The second frame element may comprise a second recess, wherein the hook element may be partially arranged in the second recess and may be connected to the second frame element.

The first and/or the second recess in the first and/or the second frame element may be a groove in the frame element. The first and/or the second frame element may be a circumferential element in the first and/or the second portion of the item of luggage.

At least one lock may be provided with the aid of which the first and the second portion of the item of luggage are adapted to be connected to each other in the closed state of the body of the item of luggage.

The body of the item of luggage may comprise at least one interior and one exterior side, wherein the hook element is arranged on the at least one interior side.

The handle may be arranged on the at least one exterior side, wherein the first interior side, where the hook element is arranged, is the corresponding interior side of the first exterior side where the handle is arranged such that the at least one hook element is located opposite to the handle.

The at least one lock may be arranged on the at least one exterior side where the handle is arranged, too.

The body of the item of luggage may comprise at least two main sides, two longitudinal sides, one upper and one lower side, wherein the one first exterior side is one of the longitudinal sides of the body of the item of luggage.

The hook element and/or the frame element may be made from a material which comprises metal.

The first frame element may be connected to the first portion of the item of luggage and the second frame element may be connected to the second portion of the item of luggage via an adhesive layer and/or screws and/or rivets.

The handle may be connected to the hook element via screws and/or rivets.

In addition, the hook element may be integrally connected to further components.

According to the present invention, a method for locking a body of the item of luggage comprising at least one first and one second portion of the item of luggage may be provided, wherein the following steps are provided:

- providing a hook element at a second portion of the item of luggage, wherein
- the hook element locks the first and the second portion of the item of luggage with each other when the loaded and closed body of the item of luggage is lifted by a handle of the item of luggage such that no gap occurs between the first and the second portion of the item of luggage.

During the locking process the hook element may engage with a first recess of a first frame element which is arranged at the first portion of the item of luggage.

BRIEF DESCRIPTION OF THE DRAWINGS

Hereunder exemplary embodiments of the present invention are described in detail with reference to the drawings in which.

DETAILED DESCRIPTION OF THE DRAWINGS

Figure 1:
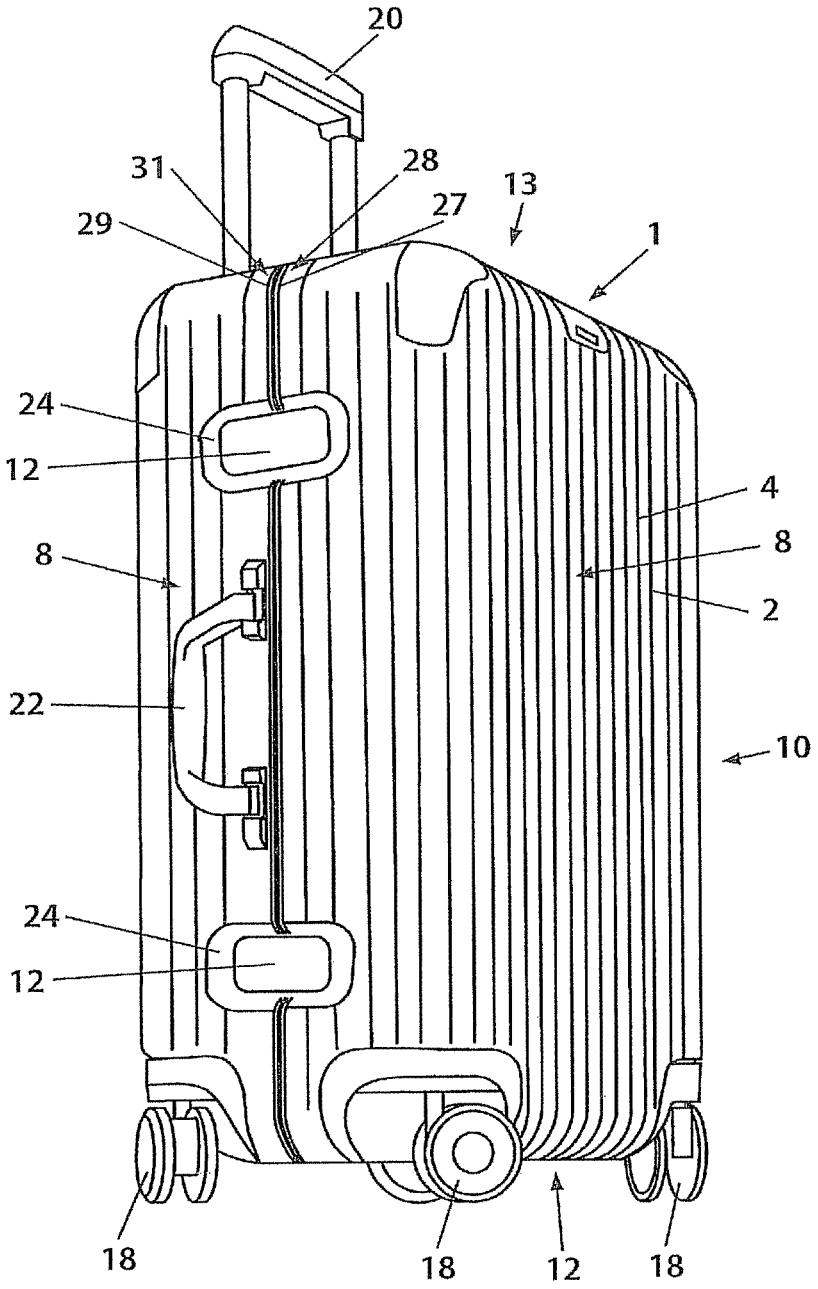
FIG. 1 schematically shows a suitcase according to the invention.

FIG. 1 shows an item of luggage according to the present invention. In the illustrated exemplary embodiment, the item of luggage is a suitcase. The item of luggage preferably comprises a body 2 of the item of luggage which includes at least one first and one second portion 4, 6 of the item of luggage. The first and the second portion 4, 6 of the item of luggage are adapted to be pivoted relative to each other such that the body 2 of the item of luggage can be opened and closed. The first and the second portion 4, 6 of the item of luggage are preferably adapted to be pivoted relative to each other via hinges not shown.

The item of luggage 1 further comprises at least one handle 22 which is connected to the second portion 6 of the item of luggage. The item of luggage 1 comprises at least one first and one second frame element 28, 31, wherein the first frame element 28 is arranged at an edge 27 of the first portion 4 of the item of luggage and the second frame element 31 is arranged at an edge 29 of the second portion 6 of the item of luggage. The item of luggage 1 may preferably comprise wheels 18 such that the item of luggage 1 is adapted to be wheeled on a floor. Further, the item of luggage 1 may comprise a telescopic handle 20.

The item of luggage 1 comprises two main sides 11, two longitudinal sides 10, an upper side 13 and a lower side 12.

Figure 2:
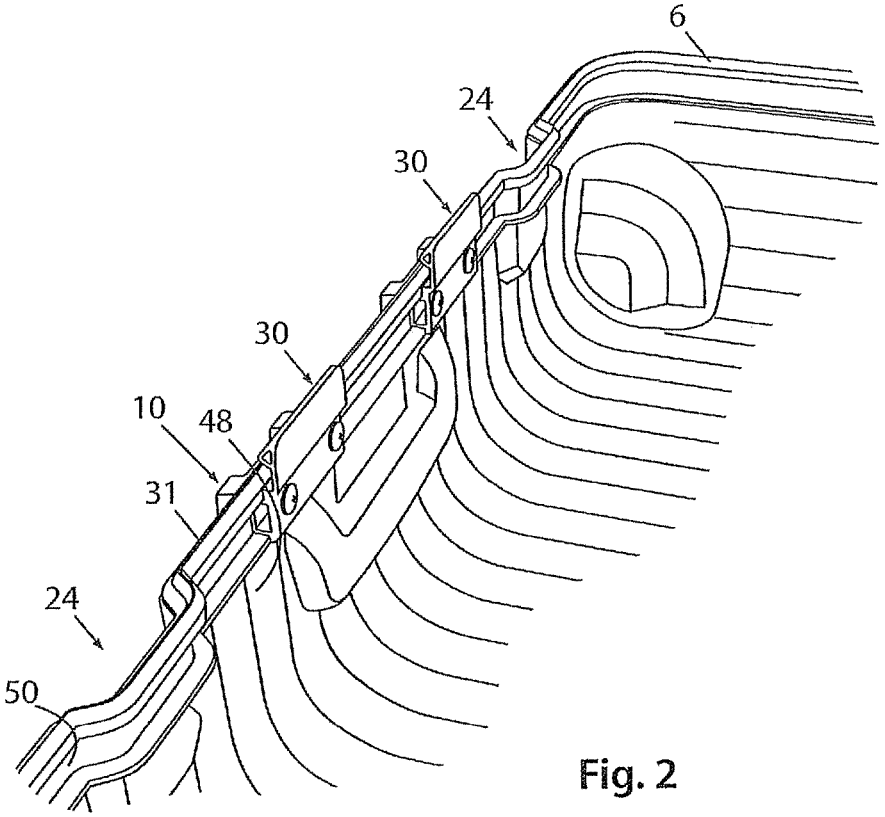
FIG. 2 schematically shows part of the second portion of the item of luggage in the open state, FIG. 3 schematically shows the first and the second frame element including the hook element, FIG. 4 schematically shows the first and the second frame element including the hook element in the open state, FIG. 5 schematically shows the engagement of the hook element with the first frame element.

In FIG. 2 the second portion 6 of the item of luggage is illustrated in the open state. In particular a first interior side 48 can be seen. This interior side 48 is the corresponding interior side to the exterior side 10 where the handle 22 is arranged. The exterior side 10 may be the longitudinal side 10, as in the illustrated exemplary embodiment. The handle 22 is connected to the second portion 6 of the item of luggage.

At the second portion 6 of the item of luggage at least one hook element 30 is arranged. In the present exemplary embodiment, even two hook elements 30 are illustrated. In FIG. 2 it can further be seen that the recesses 24 for the locks 12 are also arranged on the exterior side 10 where the handle 22 is arranged, too. The at least one hook element 30 may preferably be connected to the handle 22. In the illustrated exemplary embodiment, the hook element 30 is screwed to the handle.

The second frame element 31 may further comprise at least one second recess 50 in which part of the hook element 30 is arranged and connected to the second frame element 31. The arrangement in the second recess 50 may increase the stability of the connection between the hook element 30 and the second frame element 31.

Figure 3:
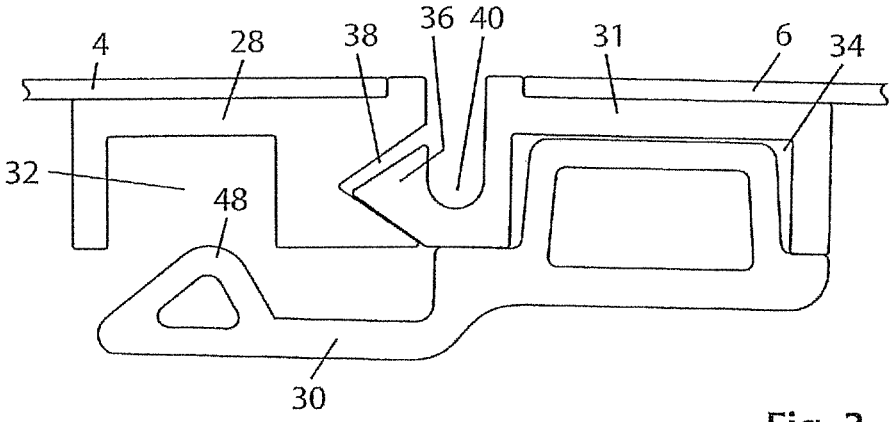

In FIG. 3 the hook element 30 is illustrated with the first and the second frame element 28, 31 and the first and the second portion 4, 6 of the item of luggage. This Figure shows a state in which the item of luggage is not lifted or not loaded. The first frame element 28 comprises a first recess 32. The hook element 30 arranged at the second portion 6 of the item of luggage extends over the first frame element 28 in the closed state of the body 2 of the item of luggage.

Figure 4:
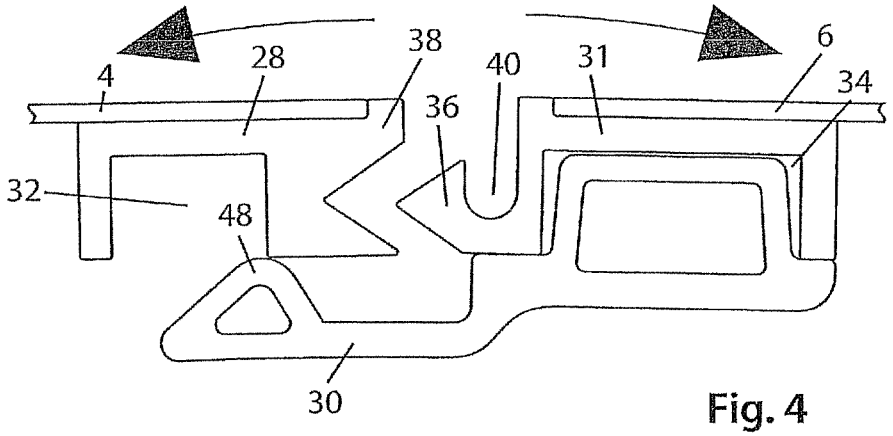

In a state in which the item of luggage 1 is not lifted the hook element 30 does not engage with the first recess 32. This is illustrated in FIG. 3. Thus the item of luggage 1 can be easily opened in this state. The opening process is illustrated in FIG. 4. FIG. 3 further shows that the first and the second frame element 28, 31 at least partially engage with each other in the closed state. For example, the projection 36 of the second frame element 31 engages with a recess 38 of the first frame element 28. Further, in the recess 40 a sealing element may be provided. This is not shown in the illustrated exemplary embodiment.

Figure 5:
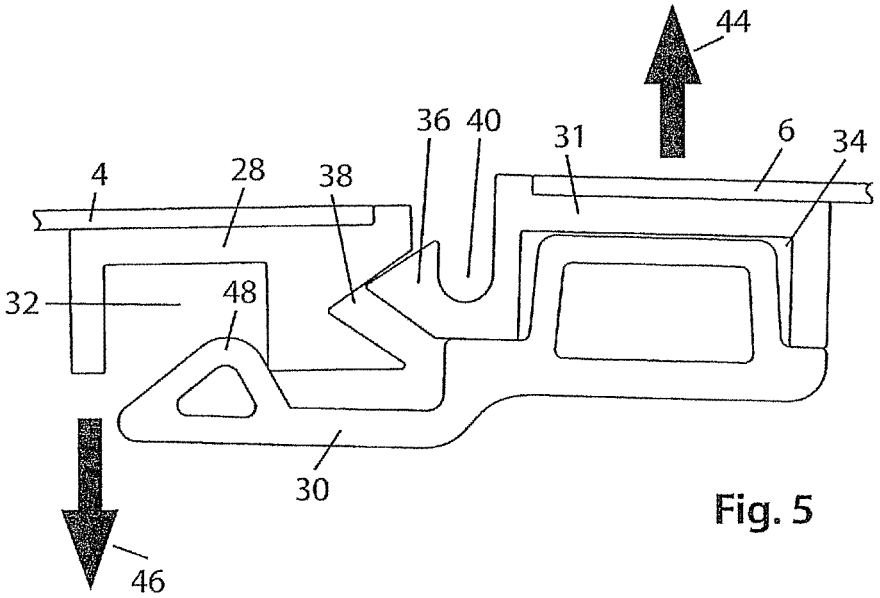

In FIG. 5 it can be seen that in a state in which the item of luggage is loaded and lifted by the handle 22 the hook element 30 engages with the first recess 32. Thus a gap is prevented from occurring between the first and the second portion 4, 6 of the item of luggage. FIG. 5 illustrates that due to the suitcase being loaded a force 46 acts upon the first portion 4 of the item of luggage in the lifted state, whereas a force 44 acts on the second portion 6 of the item of luggage via the handle. Hence the projection 48 of the hook element 30 is inserted into the first recess 32.

The hook element 30 may be connected, in particular screwed and/or glued, to the second frame element 31. The first and the second frame element 28, 31 may respectively be glued, screwed and/or riveted to the first and the second portion 4, 6 of the item of luggage. The first and/or the second frame element 28, 31 may be made of metal.

The invention claimed is:

1. An item of luggage, comprising:

a body of the item of luggage which comprises at least one first and one second portion of the item of luggage, wherein said first and said second portion of the item of luggage are adapted to be pivoted relative to each other such that said body of the item of luggage can be opened or closed;

at least one handle which is connected to said second portion of the item of luggage; and at least one first and one second frame element, wherein said first frame element is arranged at an edge of said first portion of the item of luggage and said second frame element is arranged at an edge of said second portion of the item of luggage, such that the first frame element is adjacent to the second frame element and a projection of the second frame element engages an edge recess of the first frame element when the body of the item of luggage is closed, wherein the edge recess is disposed in an edge surface facing the second frame element, and wherein at least said first frame element comprises a first interior recess disposed on an interior side of said first frame element, the first interior recess opening toward an interior of the item of luggage and at least one hook element arranged on and extending from said second portion of the item of luggage, wherein the at least one hook element is arranged on an interior side of the second portion and projects beyond the edge of the second frame element, wherein the at least one hook element is configured to adjacently overlap the first frame element when the item of luggage is closed and wherein a hook portion of the at least one hook element is configured to engage the first interior recess of the first frame element when the item of luggage is lifted by the at least one handle connected to the second portion of the item of luggage, and wherein the hook portion projects in a direction of the at least one handle.

2. The item of luggage according to claim 1, wherein the hook element is connected to the second frame element.

3. The item of luggage according to claim 1, wherein the hook element is connected to the handle through at least one of the second frame element and the second portion.

4. The item of luggage according to claim 1, wherein the first and the second frame element are aligned with each other in the closed state of the body of the item of luggage and at least partially engage with each other.

5. The item of luggage according to claim 1, wherein the second frame element has a second recess, wherein the hook element is partially arranged in the second recess and connected to the second frame element.

6. The item of luggage according to claim 1, wherein at least one lock is provided with the aid of which the first and the second portion of the item of luggage are adapted to be connected with each other in the closed state of the body of the item of luggage.

7. The item of luggage according to claim 1, wherein the body of the item of luggage has at least one interior and at least one exterior side, wherein the hook element is arranged on said at least one interior side.

8. The item of luggage according to claim 7, wherein the handle is arranged on the at least one exterior side, wherein the first interior side where the hook element is arranged is the corresponding interior side of the first exterior side where the handle is arranged, such that said at least one hook element is located opposite to the handle.

9. The item of luggage according to claim 8, wherein the at least one lock is arranged on the at least one exterior side where the handle is arranged.

10. The item of luggage according to claim 7, wherein the body of the item of luggage has at least two main sides, two longitudinal sides, one upper and one lower side, wherein the one first exterior side is one of the longitudinal sides of said body of the item of luggage.

11. The item of luggage according to claim 1, wherein the hook element and/or the frame element are made of a material that is a metal or a plastic material.

12. The item of luggage according to claim 1, wherein the handle is connected to the hook element via screws and/or rivets.

* * * * *